United States Patent [19]

Turcotte

[11] Patent Number: 4,458,895

[45] Date of Patent: Jul. 10, 1984

[54] SPHERICAL RECREATIONAL HOLLOW BODY

[76] Inventor: Jocelyn Turcotte, 12 Miquelon St., St. Camille, Canada, J0A 1G0

[21] Appl. No.: 441,487

[22] Filed: Dec. 28, 1982

[51] Int. Cl.[3] ..... A63G 29/00

[52] U.S. Cl. ..... 272/115; 280/206

[58] Field of Search ..... 272/1 B, 32, 115, 78; 280/206; 440/98-100; 441/78, 87; 273/80 D, 81.2; 52/81; 46/100, 207

[56] References Cited

U.S. PATENT DOCUMENTS

| | | | |
|---|---|---|---|
| 1,347,240 | 7/1920 | Zubryd | 441/87 |
| 2,625,356 | 1/1953 | Kennedy et al. | 272/78 |
| 2,938,727 | 5/1960 | Nosak | 272/115 |
| 3,083,979 | 4/1963 | Boyd | 280/206 |
| 3,460,828 | 8/1969 | Curlee | 272/33 R |
| 3,675,259 | 7/1972 | Gilchrist | 441/78 |
| 3,747,956 | 7/1973 | Heberlein | 280/206 |
| 3,806,156 | 4/1974 | Tidwell | 440/100 |
| 3,834,722 | 9/1974 | Rainer | 273/80 D |
| 4,042,252 | 8/1977 | Winter | 441/78 |

*Primary Examiner*—Richard J. Apley
*Assistant Examiner*—S. R. Crow

[57] ABSTRACT

A spherical hollow body for recreational use is disclosed. The sphere has a portal for exit and entry of an occupant and a plurality of ventilation apertures in its surface. Three circumferential ribs are also provided. The inside of the sphere is further provided with at least one pair of diametrically-spaced handles. In a variation of the preferred embodiment, the ribs can be provided with radially-outwardly-projecting paddles, whereby the sphere can be used on water.

5 Claims, 9 Drawing Figures

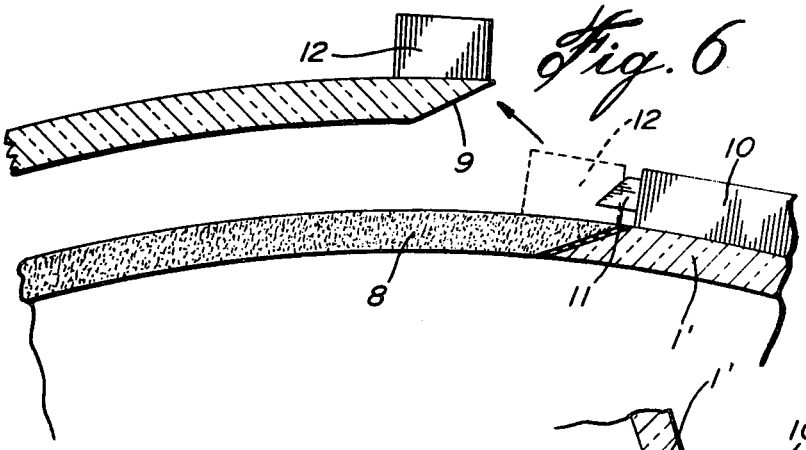
Fig. 6
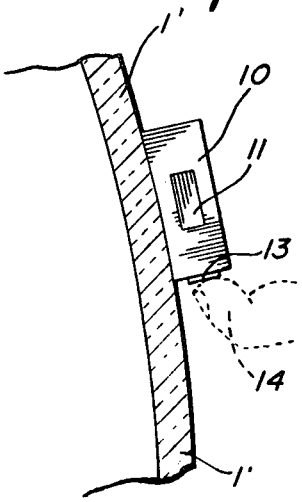
Fig. 7
Fig. 9
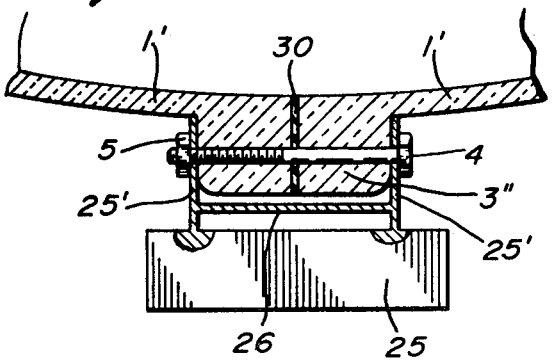
Fig. 8
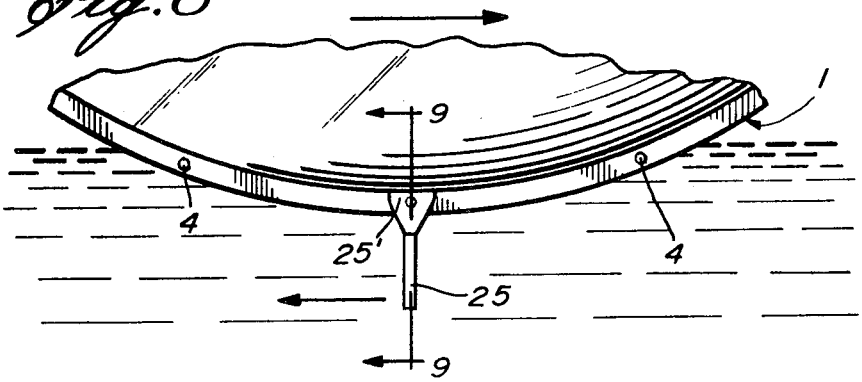

SPHERICAL RECREATIONAL HOLLOW BODY

FIELD OF THE INVENTION

The present invention relates to a toy for both adults and children, more specifically to a hollow sphere arranged to carry one person and roll over a flat supporting surface.

BACKGROUND OF THE INVENTION

Games and general recreational movement have always been enjoyed by children and adults. Various sports and exercise programs have all evolved from such enjoyment. As cases in point, one can note football, soccer, hockey, water-polo and amusement rides in play-grounds and fairs, to cite but a few activities. As for exercise programs, it has long been demonstrated that the most popular and beneficial programs are those that combine exercise with some sort of play or game-oriented structure.

OBJECTS OF THE INVENTION

Accordingly, it is a principal object of the present invention to provide a spherical hollow body made of transparent rigid material, constructed to contain a person who is able to move the sphere multidirectionally by walking on the inside surface of the sphere.

It is another object of the invention to provide a spherical body of the above type, which is provided with spaced-apart paddles all around at least one circumference of the sphere, whereby the sphere can be used on a water surface.

It is yet another object of this invention to provide a sphere of the above type, which is simple in design and non-costly to produce.

SUMMARY OF THE INVENTION

The above and other objects and advantages of the invention are realized according to a preferred embodiment, comprising a hollow body generally in the form of a sphere and made of rigid transparent unbreakable material. The surface of the sphere is provided with a plurality of ventilation apertures and a portal through which a person can enter into and exit from the sphere. Hinge means and lock means are provided for the portal.

The sphere is further provided with three circumferential external ribs: a first rib longitudinally oriented and defining a plane perpendicular to a first rotational axis of the sphere; a second rib, also longitudinally oriented, at 90 degrees to the first rib and defining a second plane perpendicular to a second rotational axis of the sphere; and a third rib latitudinally oriented and being located along the equator of the sphere.

Preferably, the outer surface of all three ribs are provided with frictional anti-skid material.

The inside surface of the sphere is further preferably provided with at least one pair of diametrically spaced-apart handles. Each of the latter has a mounting means which allows it to swing through an entire circle of arc and also to revolve about its own axis.

In a variation of the preferred embodiment, at least one of the circumferential ribs is provided with a plurality of spaced-apart and radially outwardly-projecting paddles, whereby the sphere may be moved about on water.

It is within the scope of the invention to provide a sphere, therefore, which can be moved by an occupant, either a child or an adult, who moves the sphere by walking on the inside surface while grasping the handles on either side. To stop the sphere, the occupant simply walks backwards. To change direction, the occupant turns his body in the desired direction. With a minimum amount of practice, it is possible to control the movement of the sphere in a very enjoyable way while restraining this movement to the rolling surfaces provided by the three ribs.

BRIEF DESCRIPTION OF THE DRAWINGS

The above will be more clearly understood by referring to the preferred embodiments of the invention, illustrated by way of the accompanying drawings, in which:

FIG. 6 is an enlarged cross-sectional view of FIG. 5, but showing in addition the lock means of the portal;

FIG. 7 is another cross-sectional elevation taken at 90 degrees to that of FIG. 6, showing how the lock means is activated;

FIG. 8 is a side view of the lower portion of a sphere adapted to be used in water according to a variation of the preferred embodiment; and FIG. 9 is a cross-sectional view taken along line 9—9 of FIG. 8.

Like numerals refer to like elements throughout the drawings.

DETAILED DESCRIPTION OF THE PREFERRED EMBODIMENT

Figure 1:
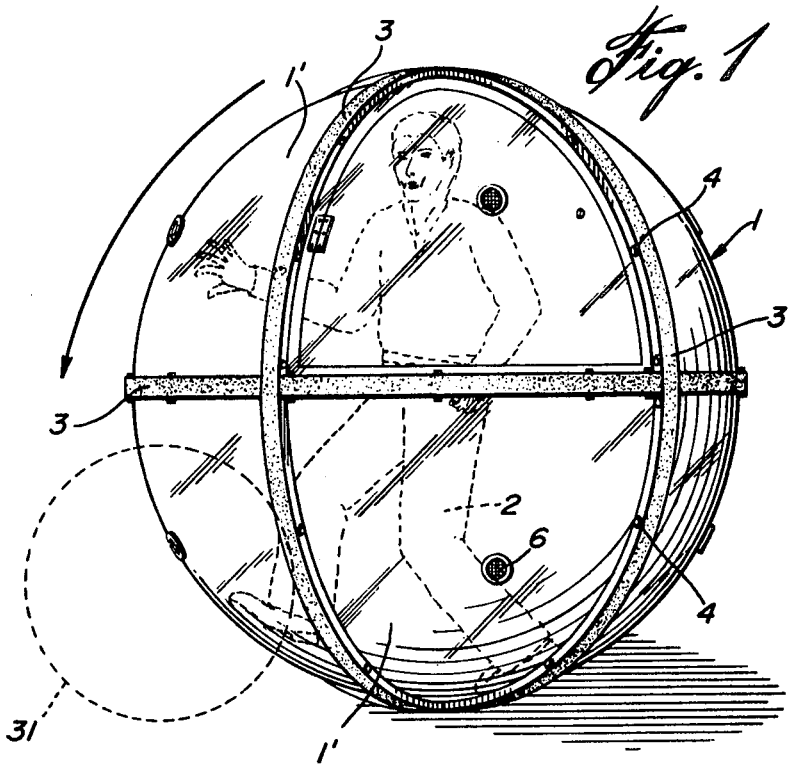
FIG. 1 is a perspective view of the sphere according to the invention.
Figure 2:
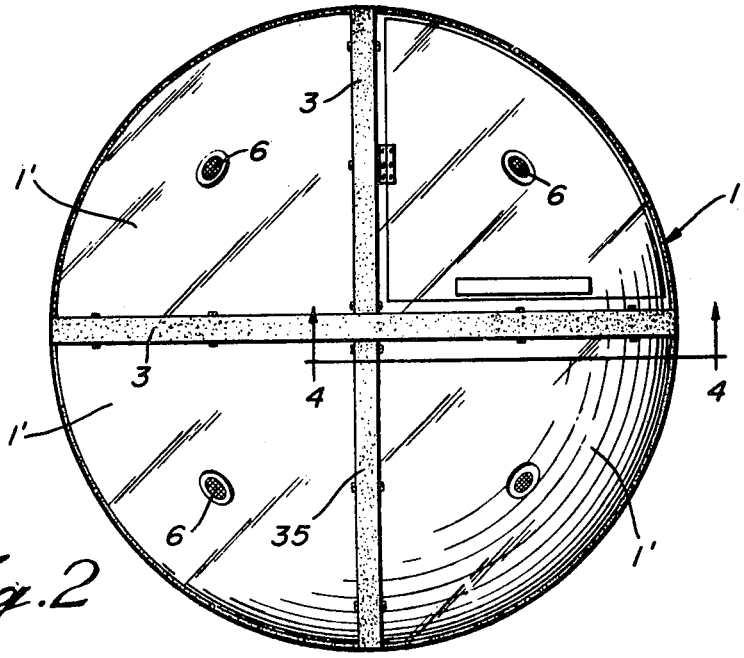
FIG. 2 is a top plan view of the sphere.

As seen clearly in FIG. 1, the invention consists of a solid hollow sphere 1, made of rigid, transparent and unbreakable material, such as polycarbonate. Sphere 1 is adapted to contain a person 2 standing upright and capable of walking therein.

Preferably, sphere 1 is formed of eight sections 1', all generally triangular and each corresponding to an eighth section of a geometric sphere.

Figure 3:
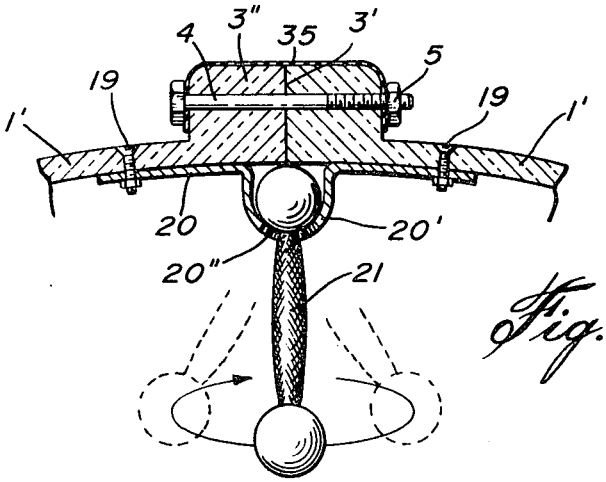
FIG. 3 is a side elevation of one handle, also showing the adjacent portion of the sphere in cross-section.
Figure 4:
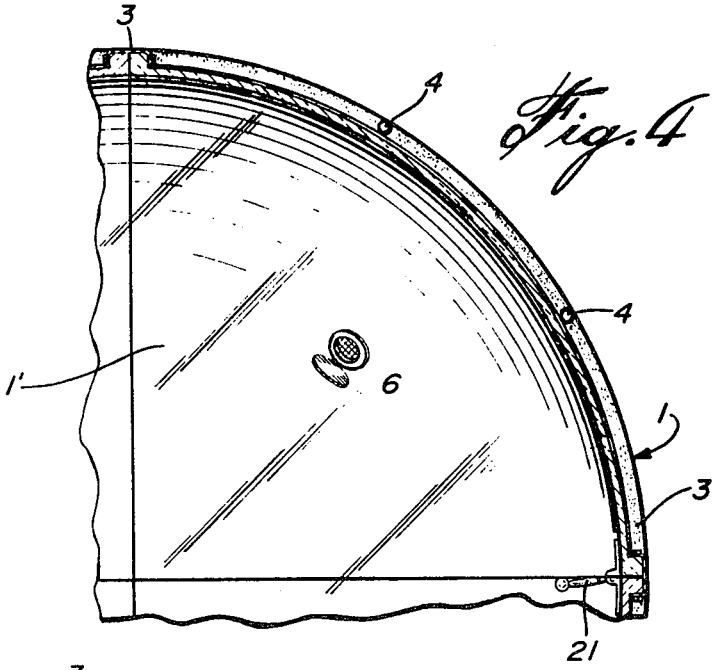
FIG. 4 is a section of an eighth portion of the sphere, taken along line 4—4 of FIG. 2.
Figure 5:
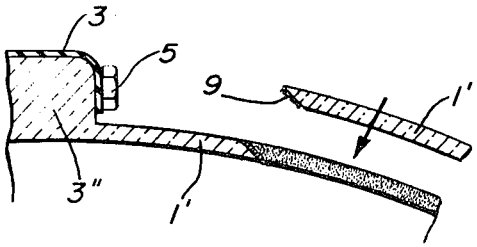
FIG. 5 is a cross-sectional view of a portion of the sphere, also showing a portion of the portal adapted to close on the same.

Each section 1' has at its three edges an outwardly-extending rib half 3'', each of the latter having a flat transverse face 3' adapted to abut against a contiguous rib half of another adjacent section 1', as shown clearly in FIG. 3. In this manner, each section 1' is rigidly secured to its three adjacent sections 1' at its rib halves 3'' by means of a plurality of circumferentially-spaced bolts 4 and nuts 5, the bolts extending through the rib halves 3''.

It will be clear that each two rib halves 3'', joined together, form three circumferential ribs 3, all around the sphere when all the sections 1' are assembled. Two of the ribs 3 are longitudinal, being spaced from each other ninety degrees, while the third rib is latitudinal, extending around the equator of the sphere (as shown in FIG. 1; of course, the terms latitudinal and longitudinal are relative). Preferably, each rib 3 has an outer surface provided with anti-skid material 35.

The sphere 1 is provided with a plurality of ventilation apertures 6.

Sphere 1 is further provided with a portal for the entry and exit of the occupant. The portal is simply made in one of the sections 1' and is pivotally attached to the marginal part of said section by means of hinge 7 secured to one side thereof. At least one of the edges of the portal opposite the hinged edge is provided with a fastening means, preferably a strip 8, of material known under the registered trademark "VELCRO", as shown in FIG. 6. Preferably, also, this edge is bevelled inwardly, as shown at 9 in FIG. 6. It will be evident that strip 8 serves also as a sealing means.

In order to prevent the portal from opening during rolling movement of the sphere 1, a lock means is provided for the portal, this lock means being illustrated in FIGS. 6 and 7 and consisting of a barrel 10 rigidly secured to the portal adjacent its bevelled edge 9. Barrel 10 contains a spring-loaded tongue 11 adapted to engage a slot made in a block 12, the latter being secured to the section 1' adjacent the said edge of the portal. Tongue 11 is retracted by pressing a button 13, in a known manner. Button 13 is operated by a finger 14.

In order to provide a support and directional stability to the user of sphere 1, at least two diametrically spaced-apart handles 21 are provided inside sphere 1. One of these is shown in FIG. 3; a plate 20 conforming to the curvature of sphere 1 is rigidly secured to the inner surface of sphere 1 directly underneath one of the ribs 3 by means of screws 19. The central portion of plate 20 is formed in an inwardly-extending bell-shaped bulge 20' having a wide circular opening 20" at its inner end. A dumbbell-shaped handle 21 has one of its balls engaged in bulge 20', whereby it can swing through a fairly wide circular arc and also pivot about its own longitudinal axis. Thus, the user grabs both handles with his or her hands while "walking" inside the sphere.

In a variation of the preferred embodiment, sphere 1 is adapted to float and move on water. To provide motive means, at least one circumferential rib 3 is provided with a plurality of outwardly radially-projecting paddles 25, which are also equally spaced from each other. Each paddle 25 is formed with a pair of laterally-spaced flanges 25', which fit on either side of a rib 3, being secured thereto by bolt 4 and nut 5. A reinforcing strip 26 is provided between the flanges 25'.

FIG. 8 shows how paddles 25 extend in the water to enable forward movement of sphere 1 by walking inside the latter.

In FIG. 9, there is shown a sealing strip 30, made of rubber or plastic, located between the rib halves 3" to make sphere 1 watertight.

It will be appreciated that sphere 1 can be enjoyed either singly or in groups. For example, FIG. 1 shows a ball 31 in dashed outline, which may be used in a game, played on a demarcated field, which would have rules and opposing teams.

What I claim is:

1. A vehicle for movement on the ground, comprising an enclosed spherical hollow body made of rigid, transparent unbreakable material, said hollow body being provided with a portal hole for entry and exit of one person, and having an external diameter sufficient for a person to stand upright and walk within said body, the surface of said body being provided with a plurality of ventilation apertures, said body being further provided with three circumferential ribs at right angles to each other and extending in respective diametrical planes, said ribs radially outwardly protruding from the external surface of said body and each defining a circular outer rolling surface.

2. A vehicle as claimed in claim 1, wherein said hollow body and ribs are formed of eight detachably-attached generally triangular sections, each section having at its three edges an outwardly-extending rib half, each of the latter having a flat transverse face abutting against the similar flat transverse face of a contiguous rib half of an adjacent section, and fastening means removably securing each pair of contiguous rib halves together, whereby each section is removably secured to three adjacent sections, said rib halves forming said three circumferential ribs when assembled.

3. A vehicle as defined in claim 1, further including paddles removably secured to at least one of said ribs in spaced-apart positions circumferentially of said rib, each paddle consisting of a plate member extending radially outwardly from said body and transversely of said rib, whereby said vehicle is adapted to move on water.

4. A vehicle as defined in claim 1, further including at least one pair of diametrically spaced-apart handles located inside said spherical body and mounting means attaching each of said handle to said body and allowing each handle to swing through a circular arc and also pivot about its own axis relative to said body and mounting means.

5. A vehicle as defined in claim 4, wherein said mounting means consists of a plate conforming to the curvature of the hollow body and rigidly secured thereto opposite one of said ribs against the inner surface of said hollow body, said plate having a central inwardly-extending bell-shaped bulge having a wide circular opening at its inner end; each handle having a dumbbell-shape having one of its balls rotatably engaged in said bulge.

* * * * *